US005188410A

United States Patent [19]

Summers

[11] Patent Number: 5,188,410

[45] Date of Patent: Feb. 23, 1993

[54] DEFORMABLE BALL RETRIEVING, RETAINING AND DISPENSING DEVICE

[76] Inventor: Michael E. Summers, 11 Woodbine Dr., Wesley Chapel, Fla. 34249

[21] Appl. No.: 804,299

[22] Filed: Dec. 9, 1991

[51] Int. Cl.[5] ..... A63B 47/02

[52] U.S. Cl. ..... 294/19.2; 273/29 R

[58] Field of Search ..... 294/19.2; 221/307, 310; 56/328.1; 224/919; 273/29 R, 32 D; 403/300, 308, 349

[56] References Cited

U.S. PATENT DOCUMENTS

| | | | |
|---|---|---|---|
| 2,027,546 | 1/1936 | MacDonald | 294/19.2 |
| 2,218,825 | 10/1940 | Le Guillou | 294/19.2 |
| 2,760,807 | 8/1956 | Watson | 294/19.2 |
| 3,186,593 | 6/1965 | Miotke | 273/32 D X |
| 3,663,049 | 5/1972 | James | 294/19.2 |
| 3,901,545 | 8/1975 | Shott | 294/19.2 |
| 4,298,142 | 11/1981 | Stanley | 221/310 X |
| 4,398,716 | 8/1983 | Argibay, Jr. et al. | 294/19.2 X |
| 4,629,235 | 12/1986 | Logue | 294/19.2 |
| 4,678,108 | 7/1987 | Inman | 294/19.2 X |
| 4,964,665 | 10/1990 | Crow | 294/19.2 |

FOREIGN PATENT DOCUMENTS 682885 11/1952 United Kingdom ..... 294/19.2

*Primary Examiner*—Charles A. Marmor
*Assistant Examiner*—Dean J. Kramer
*Attorney, Agent, or Firm*—Niro, Scavone, Haller & Niro

[57] ABSTRACT

An improved deformable ball retrieving, retaining and dispensing device is disclosed. The device includes an elongated tubular member having one or more sections which can be easily assembled and disassembled. The tubular member has an upper end with a dispensing opening for discharging retained balls when the tubular member is inverted, a lower end forming a retrieving opening, and an internal passage connecting each of the ends and of slightly greater dimension than the diameter of the balls to be contained. The device also includes a smooth retaining mechanism which is positioned entirely within the lower end of the tubular member and receives the deformable ball while preventing retractive movement of the ball once the ball has been received within the tubular member.

2 Claims, 2 Drawing Sheets

DEFORMABLE BALL RETRIEVING, RETAINING AND DISPENSING DEVICE

BACKGROUND OF THE INVENTION

This invention relates generally to devices for retrieving, retaining and dispensing deformable balls, such as tennis balls, thus minimizing the manual effort required to gather up loose balls.

During the practice of sporting activities such as tennis, players sometimes hit a large number of balls which then lie about on the tennis court or other playing surface. Players must then retrieve the balls and place them in a suitable container for storage until use is again desired. It is therefore desireable to provide an apparatus for retrieving and dispensing tennis balls, allowing the user to enjoy more practice time compared to the time spent in retrieving the balls. It is also desireable to eliminate the necessity to bend over and pick up the balls.

Accordingly, U.S. Pat. Nos. 3,957,297 and 4,045,068 to Hanks and Nelson, respectively, are directed to such apparatus. But each of those patents disclose devices having sharp edges in and around the retrieval opening. Those devices are also relatively complicated and expensive to manufacture. And, neither of these devices disclose any telescoping or extended arm capability.

SUMMARY OF THE INVENTION

This invention provides advantages not found in currently available devices and overcomes the disadvantages associated with those devices, including the disadvantages discussed above.

An object, therefore, of the present invention is the provision of a device which will retrieve, retain and dispense deformable balls such as tennis balls.

A second object of the present invention is the provision of a device of the character described which utilizes a benign retaining means devoid of jagged edges or sharp surfaces in or about the retrieval opening.

A third object of the present invention is the provision of a device of the character described which is easily assemblable and inexpensive to manufacture.

A fourth object of the present invention is the provision of a device of the character described which includes multiple short sections which can be easily assembled and disassembled for travel, and whose connections can be manufactured inexpensively.

These and other objects are achieved by the present invention, an improved deformable ball retrieving and retaining device. Such devices normally include an elongated tubular member having an upper end forming a dispensing opening adapted to discharge retained balls when the tubular member is inverted, a lower end forming a retrieving opening, and an internal passage connecting each of the ends and of slightly greater dimension than the diameter of the balls to be contained therein. Such devices also include retaining means positioned at the lower end of the tubular member for receiving a deformable ball and for preventing retractive movement of the ball once the ball has been received within the tubular member.

Applicant's invention further includes retaining means adapted such that a ball and/or the retaining means must be deformed to allow passage of the ball into the tubular member. This invention also requires that the retaining means be positioned entirely within, be arranged around, and project inwardly of, the internal perimeter of the retrieving opening, forming no jagged edges or sharp surfaces therein. Preferably, this invention also includes a retaining element, containing the retaining means, which is slidably inserted within the lower end of the tubular member, thereby forming the retrieval opening.

In a second, preferred, embodiment of the present invention, the tubular member includes first and second separate tubular housings. These housings or sections are joined between a tubular connecting insert, identical to the retaining element but for the absence of any retaining means, such that one end of the first tubular housing is adapted to slidably insert within the larger end of the retaining element, and the smaller end of the retaining element is adapted to slidably insert within one end of the second tubular housing. In this preferred embodiment, one end of either the first or second tubular housing also accommodates th retaining element (which contains the retaining means). Use of a single tubular connecting insert identical to the retaining element (except for lack of retaining means) obviates the need for complex, expensive threaded fasteners such as those used in U.S. Pat. No. 4,522,438 (Logue) to achieve collapsibility.

BRIEF DESCRIPTION OF THE DRAWINGS

The novel features of this invention are set forth with particularity in the appended claims. The invention, together with its objects and the advantages thereof, may best be understood by reference to the following description taken in conjunction with the accompanying drawings, in which like reference numerals identify like elements in the figures and in which:

DETAILED DESCRIPTION OF PREFERRED EMBODIMENT

Figure 1:
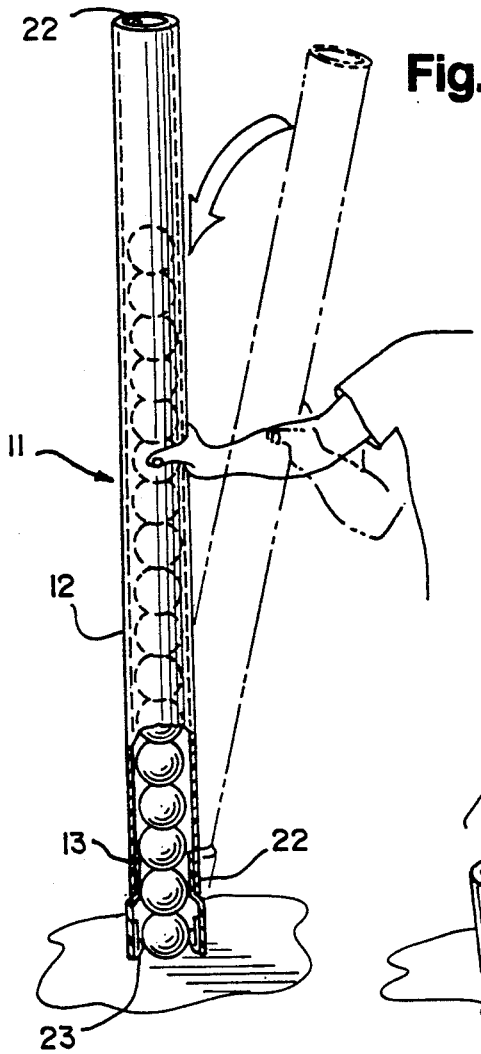
FIG. 1 is a perspective view of the device of this invention.
Figure 2:
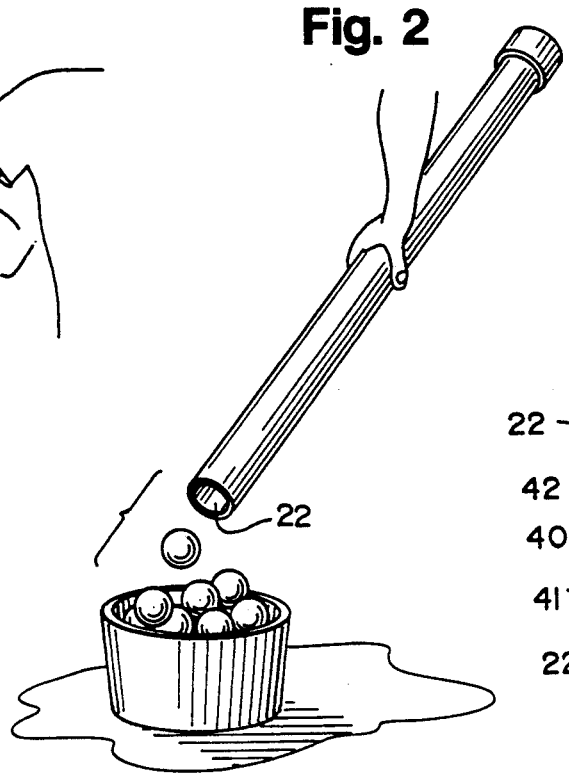
FIG. 2 is a perspective view of the device inverted and in the act of dispensing a ball.

Referring now to the drawings and first to FIG. 1, a ball retrieval, retaining and dispensing device, designated generally as 11, is in the general form of an elongated tubular housing 12, and a retaining element 13. Housing 12 includes a dispensing opening 22. A retrieval opening 23 is formed by the lower end of retaining element 13. Housing 12 and retaining element 13 can be formed from any one of a number of suitable metal or plastic materials. More preferably, to ensure durability, these elements are formed of plastic material which will not become permanently dented or otherwise deformed during storage, transportation, or use.

The smaller end 16 of insert 13 fits within one end 22 of tubular housing 12. Each of ends 22 of tubular housing 12 are identical in size and shape. These ends 22, either of which may serve as dispensing ends, are sized to allow balls to pass freely through them when housing 12 is inverted.

Figure 3:
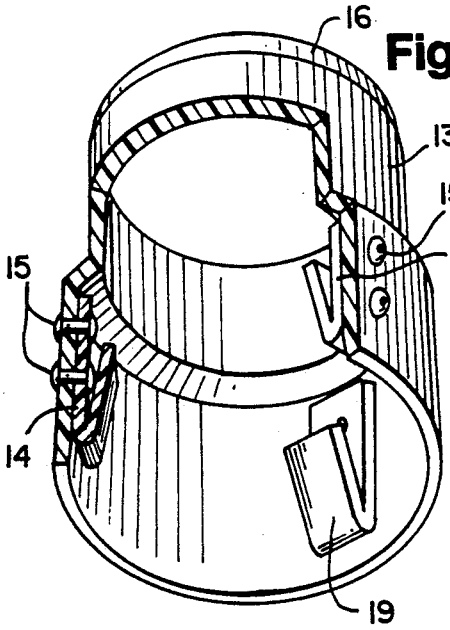
FIG. 3 is an exploded, partial cross-section, perspective view of the retaining element (shown with retaining means) of the present invention.
Figure 4:
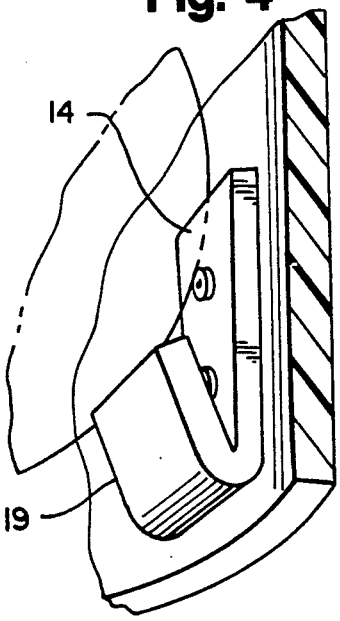
FIG. 4 is an exploded, generally side, perspective view of a retaining clip which constitutes a retaining means of the present invention.
Figure 6:
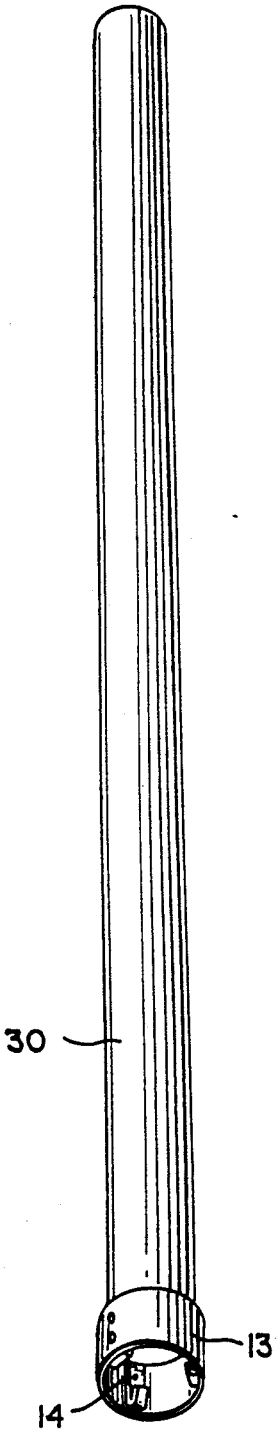
FIG. 6 is a perspective view of the tubular member of the present invention, connected to the tubular retaining element.
Figure 7:
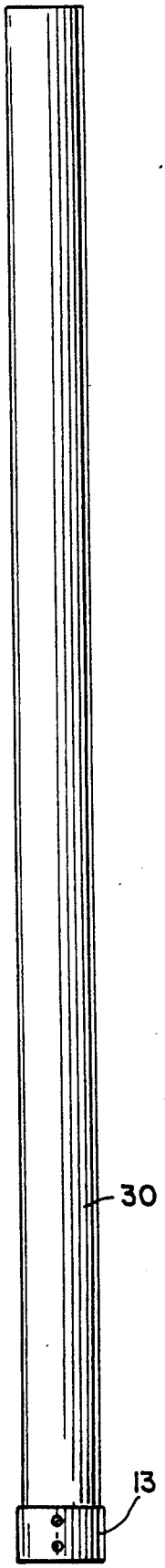
FIG. 7 is a perspective view of the tubular section of the present invention, connected to the tubular retaining element.
Figure 8:
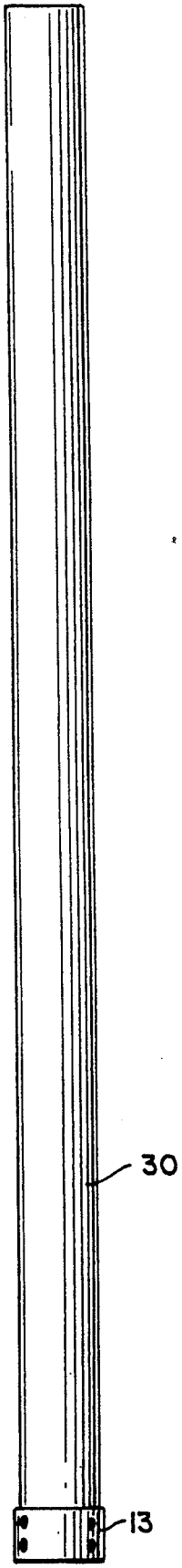
FIG. 8 is a perspective and rotated view of the tubular section of FIG. 7 of the present invention, connected to the tubular retaining element.
Figure 9:
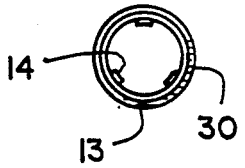
FIG. 9 is an end view of FIG. 7.
Figure 10:
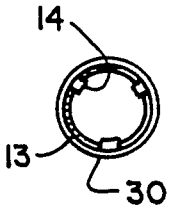
FIG. 10 is an end view of FIG. 8.

Referring now to FIG. 3, retaining element 13 will now be described in more detail. Retaining element 13 includes flexible retaining means such as retaining clips 14, which are rigidly connected to the internal wall of retaining element 13 by fasteners 15, such as rivets 15. Rivets form only smooth surfaces along the outer wall of retaining element 13. Retaining clips 14 are preferably constructed of plastic, and also form no jagged edges or sharp surfaces within the interior of retaining element 13.

Retaining clips 14 are positioned about the internal periphery of retaining element 13 and are sized and shaped such that a deformable ball, such as a tennis ball, must be deformed in order to pass through the retrieval opening created by retaining element 13, and retaining clips 14. Retaining clips 14 include a flexible slanted portion 19, which may also flex in response to the ball pressure as the ball deforms to pass the retrieval opening.

Figure 5:
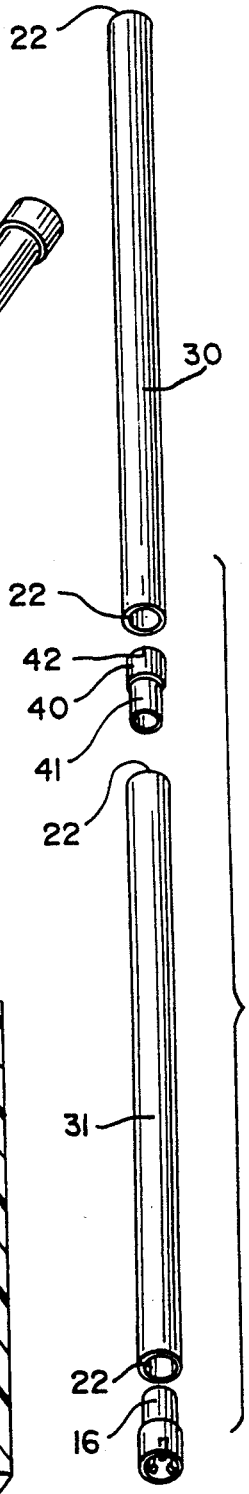
FIG. 5 is a perspective view of the elongated tubular sections, prior to connection to the tubular connecting element.

Referring now to FIG. 5, integral tubular housing 12 may be replaced with two separate elongated housings 30 and 31. Each of tubular housings 30 and 31 has identical ends 22, any one of which can serve as dispensing ends. Separate housings 30 and 31 are joined by tubular connecting insert 40, which is identical in size and shape to tubular retaining element 13, except that connecting insert 40 does not contain any retaining means, such as retaining clips 14. The female end 41 of tubular connecting insert 40 is sized to slidably insert within one end 22 of tubular housing 31, and another end 22 of housing 30 slidably inserts within the male end 42 of tubular connecting insert 40. Since tubular connecting insert 40 is appropriately sized to develop a substantial friction force at its joints with both housings 30 and 31, there is no need to use separate fastening means to secure the housings together. This is so because device 11 will undergo compression forces as the retrieval opening is thrust down over a ball, but will not undergo substantial tension forces tending to pull the tubes apart.

It will of course be understood that any of a variety of retaining means can be used in place of clips 14, including flexible rubber flappers with vertical retaining stops positioned above the flappers, or other means. Also, of course, clips 14 can be integrally molded to housings 30 or 31 to form a unitary piece. The constraint of the retaining means is that it include no jagged edges or sharp surfaces which might cause injury to those, such as young children, who might inadvertently, or simply out of curiosity, reach into the retrieval opening. This, among other features, distinguish Applicant's invention from such prior art devices as U.S. Pat. No. 2,027,546 (MacDonald) and 1,937,828 (MacDonald), which involve sharp springs.

As mentioned above, tubular retaining element 13 and tubular connecting insert 40 are identical in size and shape, except that retaining element 13 includes retaining means contained entirely within the tube, such as retaining clips 14. Still further, tubular housings 30 and 31 are identical in diameter. Also, no separate securing or fastening means are necessary to connect together two or more sections, such as housings 30 and 31 shown in FIG. 5, using tubular connecting insert 40. For each of these reasons, Applicant's invention is very inexpensive to manufacture and can be sold at a price that is more competitive than prior art devices.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. An improved deformable ball retrieving, retaining and dispensing device, including an elongated tubular member having an upper end forming a dispensing opening adapted to discharge retained balls when the tubular member is inverted, a lower end and an internal passage connecting each of the ends and of slightly greater dimension than the diameter of the balls to be contained therein; and retaining means for receiving a deformable ball and preventing retractive movement of the ball once the ball has been received within the tubular member, said retaining means adapted such that a ball or the retaining means must be deformed to allow passage of the ball into said tubular member, the improvement comprising:

a tubular retaining element having a first end adapted to be slidably inserted within the tubular member, and a second end forming a retrieving opening adapted to accommodate the retaining means, whereby the retaining means is positioned entirely within, is arranged around, and projects inwardly of, the internal perimeter of said retrieving opening, and forms no jagged edges or sharp surfaces therein, said tubular member includes at least first and second separate tubular housings being substantially the same circumference as each other and aligned end to end;

said separate tubular housings being joined together by a tubular connecting insert, being of a shape substantially identical to said retaining element, having first and second ends;

whereby said first end of said tubular connecting insert is adapted to slidably insert within one end of said first tubular housing, and an end of said second tubular housing is adapted to slidably insert within said second end of said tubular connecting insert permitting passage of a ball through said first and second tubular housings; said retaining element being connected to a distal end of said first tubular housing which is not connected to said tubular connecting.

2. An improved deformable ball retrieving, retaining and dispensing device having a first and second tubular member, comprising:

an elongated tubular member having an upper end forming a dispensing opening adapted to discharge retained balls when the tubular member is inverted, a lower end and an internal passage connecting each of the ends and of slightly greater dimension than the diameter of the balls to be contained therein;

a tubular retaining insert having a first section with an outer circumference approximately equal to the inner circumference of said tubular member, and a second section with an inner circumference approximately equal to the outer circumference of said tubular member;

a plurality of V-shaped retaining elements each having a first section affixed to the inner wall of said tubular insert and a shorter second section integrally connected in biased fashion to said first section;

said first and second tubular members are joined together by a tubular connecting insert being of a shape substantially identical to said tubular retaining insert; said tubular connecting insert having first and second ends, whereby said first end is adapted to slidably insert within one end of said first tubular member and within an end of said second tubular member; connection of said first and second tubular members permits passage of a ball through both said first and second tubular members; said retaining insert being connected to a distal end of said first tubular housing not connected to said tubular connecting insert.

* * * * *